US008622193B2

(12) United States Patent
Gonzalez Alemany et al.

(10) Patent No.: US 8,622,193 B2
(45) Date of Patent: Jan. 7, 2014

(54) BIDIRECTIONAL MOVING WALKWAY

(75) Inventors: Miguel Angel Gonzalez Alemany, Oviedo (ES); Alberto Pello Garcia, Piedras Blancas (ES); Juan Domingo Gonzalez Patinga, Gijón (ES); Alberto Cancio Fervienza, Oviedo (ES); Alberto Florez Castro, Lugo de Llanera (ES)

(73) Assignee: Thyssenkrupp Elevator Innovation Center, S.A., Gijon, Asturias (ES)

( * ) Notice: Subject to any disclaimer, the term of this patent is extended or adjusted under 35 U.S.C. 154(b) by 0 days.

(21) Appl. No.: 13/612,294

(22) Filed: Sep. 12, 2012

(65) Prior Publication Data

US 2013/0092507 A1 Apr. 18, 2013

(30) Foreign Application Priority Data

Sep. 19, 2011 (ES) ..... 201131508

(51) Int. Cl.
*B66B 23/18* (2006.01)
*B66B 23/02* (2006.01)

(52) U.S. Cl.
CPC ..... *B66B 23/18* (2013.01); *B66B 23/02* (2013.01)
USPC ..... 198/329; 198/330; 198/322

(58) Field of Classification Search
USPC ..... 198/329, 330, 322
See application file for complete search history.

(56) References Cited

U.S. PATENT DOCUMENTS

| | | | | |
|---|---|---|---|---|
| 4,284,192 | A * | 8/1981 | Taylor | 198/813 |
| 5,307,920 | A * | 5/1994 | Meyer et al. | 198/335 |
| 5,641,058 | A * | 6/1997 | Merten et al. | 198/810.04 |
| 7,543,696 | B2 * | 6/2009 | Aulanko et al. | 198/329 |
| 7,861,843 | B2 | 1/2011 | Aulanko et al. | |

* cited by examiner

*Primary Examiner* — Mark A Deuble
(74) *Attorney, Agent, or Firm* — Merchant & Gould P.C.

(57) ABSTRACT

A bidirectional moving walkway with a tightening system for tightening the band of pallets of the walkway includes two tightening units (6, 6') arranged at each end of the moving walkway and each including a locking system for locking the movable frame (7) of each end tightening unit (6, 6'). Two drive units (3, 3') are each arranged at either end of the moving walkway. The locking system of each tightening unit (6, 6') of either end of the walkway is configured for locking the operation of the tightening unit (6, 6') when the drive unit (3, 3') of its same end is operated, such that the moving walkway always works with the tightening unit operated by the passenger entrance end and locked by the passenger exit end.

5 Claims, 3 Drawing Sheets

BIDIRECTIONAL MOVING WALKWAY

This application claims benefit of Serial No. 201131508, filed 19 Sep. 2011 in Spain and which application is incorporated herein by reference. To the extent appropriate, a claim of priority is made to the above disclosed application.

FIELD OF THE INVENTION

The present invention relates to moving walkways and more specifically to moving walkways used for transporting people and goods and which are formed by an endless band of pallets, moving on side guides and have bidirectional operation.

BACKGROUND OF THE INVENTION

Conventional moving walkways for the indicated purpose are formed by a band of pallets which move on side guides, which pallets are secured and fitted on a structure supporting the weight of the components and users. The walkways are further provided with a glass or opaque balustrade which is also secured to the same support structure and on which a handrail moves at the same speed as the pallets.

Conventional systems for transporting passengers/goods such as moving walkways include a chain of conveyor pallets which move in a track for the purpose of providing a continuous movement along a specific path. The conveyor pallets are connected to said chain track which moves as a result of a drive system. The drive system normally consists of a chain of conveyor plates, cogged wheels, a shaft and an electric geared motor. The electric motor drives the shaft to which there are integrally attached cogged wheels, which transmit the movement to the links of the chain of conveyor pallets. The conveyor pallets move in the same manner as said chain. The drive system is located at one of the ends of the moving walkway whereas the elements responsible for tightening the system are normally located at the opposite end. The turnover of the conveyor pallets which travel the entire moving walkway in the lower part completing the return trip occurs at these end areas of the moving walkway.

The function of the tightening system is to assure minimum stress in the band/chain of pallets such that it works with tensile stresses through as much of its path as possible and to prevent the possible "pilling-up" of the chain in the operation due to low stress.

In the particular case of a flat walkway operating in the upwards direction (passengers enter through the end of the tightening system 2 and exit through the end of the drive unit 3) the stress distribution line 4 along the walkway as well as the zero tension level 1 of the moving walkway corresponds to that shown in FIG. 2, FTup being the climbing stress. In the turnover of the lower head the stress is mainly fixed by the action of the tightening system, from hereon, and in the forward direction of the walkway, the stress on the band/chain of pallets (FTup) rise due to friction forces generated as a result of the weight of the passengers applied on this branch together with the weight itself, until reaching its maximum value at the upper end of the unit right at the entrance to the drive unit 3. The stress is unloaded in the drive unit to a minimum value to then be increased along the lower return path as a result of the friction forces produced by the weight of the band of pallets itself until reaching the lower turnover where the stress is approximately that of the tightening system.

As can be deduced from this explanation, if the band of pallets lengthen, stress loss will occur in the band of pallets which will mainly appear in the lower return path for the upwards direction. As a result, applying a Tfup stress is necessary for assuring a correct operation of the system as seen.

FIG. 3 shows the diagram of stress distributions 4' of a walkway in the downwards direction in which the zero tension level 1' is shown. When the drive system pushes the band/chain of pallets the point of minimum stress will be at the exit of the drive unit 3. Depending on the loading state of the walkway, its length and the stress applied by the tightening system, this stress value can be negative as seen in FIG. 3. The stress increases little by little along the upper branch in the travelling direction until reaching the end of the tightening unit where the stress is basically that fixed by the tightening unit. Then the stress increases in the lower return branch as a result of the friction of the band of pallets along the travelling direction of the walkway until reaching the turnover of the upper end. The maximum stress value will be reached right at the entrance of the drive unit.

Therefore, it can be deduced that the stress which the tightening system must provide in this case will have to be greater than in the above case since the negative stress value must be prevented as much as possible at the exit of the operation.

If this stress is applied in a fixed and invariable manner to a bidirectional walkway in the upwards travelling direction, the band/chain of pallets and particularly its rollers will be subjected to stresses larger than that necessary in the turnovers which leads to unnecessary wear, therefore reducing its service life and the need to use more robust elements with a higher cost, since the upwards travelling direction will usually be the most common.

Kone's U.S. Pat. No. 7,861,843 B2 describes a tightening system varying its stress dynamically depending on the situation of the system or on the direction of rotation: The stress provided by the tightening system in the upwards direction will be less than in the downwards direction.

SUMMARY OF THE INVENTION

The present invention relates to a bidirectional moving walkway with a tightening system for tightening the band/chain of pallets and two drive units, one at each end of the moving walkway, involving a modification in the concept of tightening system conventionally used in moving walkways.

The tightening system comprises two tightening units, one at either end of the moving walkway, each comprising a locking system for locking the movable frame of each end tightening system, the locking system of each tightening system of either end of the walkway being configured for locking the operation of the tightening system when the drive unit of its same end is operated, such that the moving walkway always works with the tightening system operated by the passenger entrance end and locked by the passenger exit end. The stresses of each of the tightening systems will thus be adjusted such that the operation of the walkway in that direction is optimised.

Figure 1:
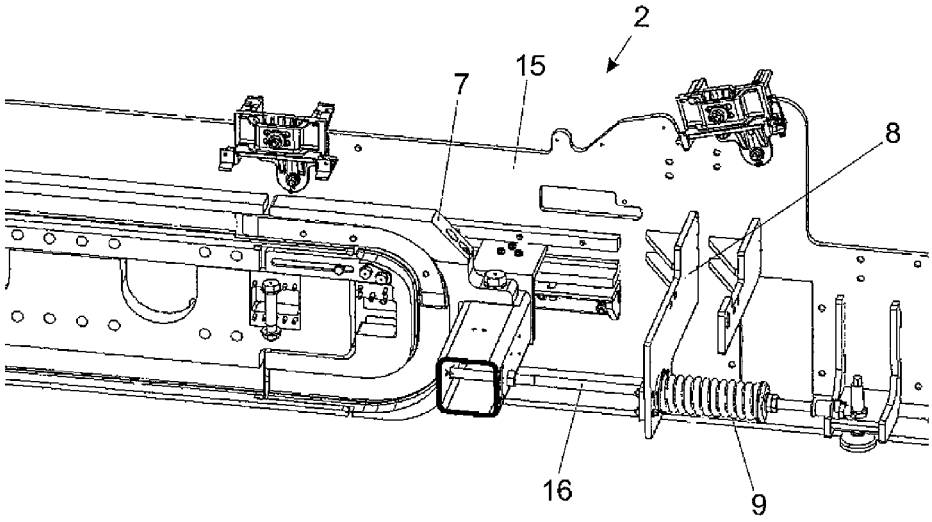
FIG. 1 shows a perspective view of one end of a conventional walkway.

A series of references corresponding to the elements indicated below are identified in the aforementioned figures, without them having a limiting character whatsoever:

1.—"zero" tension level of a moving walkway with a conventional tightening system
2.—conventional tightening system
3.—drive unit
4.—stress distribution line of moving walkway with conventional tightening system
5.—"zero" tension level of a moving walkway with the tightening system of the invention
6.—tightening unit
7.—movable frame
8.—cross wall of the fixed frame
9.—tension spring
10.—fixed locking part
11.—cogged rod
12.—actuator
13.—shoe
14.—stress distribution line of a walkway with the tightening system of the invention
15.—side wall of the fixed frame
16.—shaft of the spring

DETAILED DESCRIPTION OF AN EMBODIMENT

Figure 4:
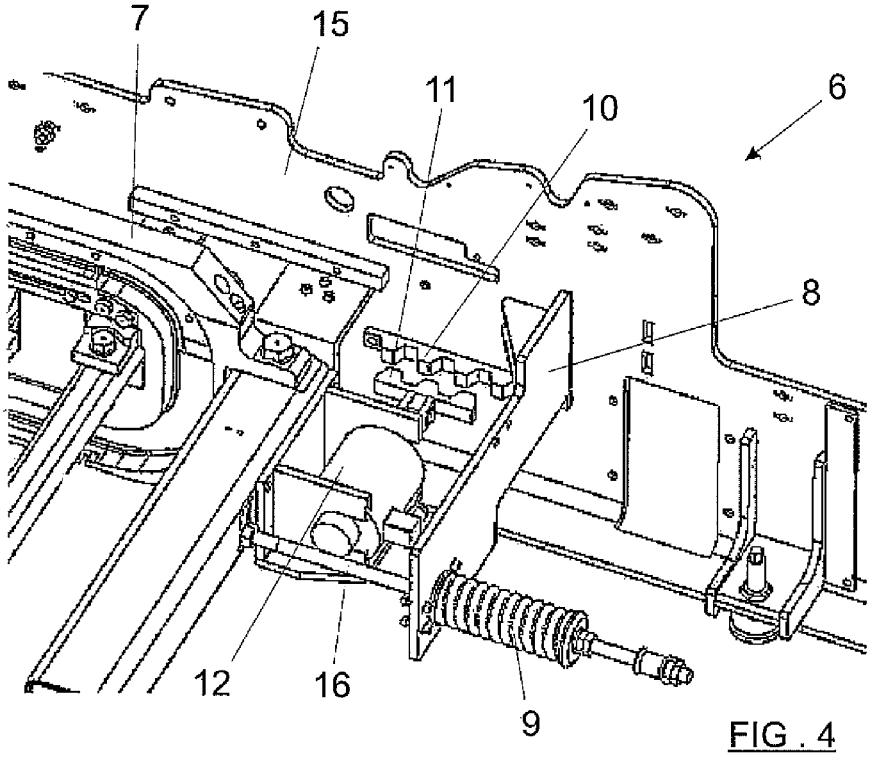
FIG. 4 shows a perspective view of one end of the walkway with the tightening system of the invention.
Figure 5:
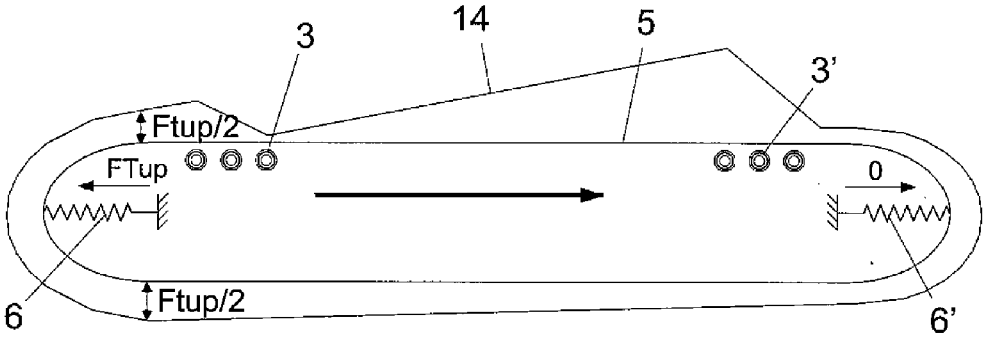
FIG. 5 shows the stress distributions in a walkway provided with the lockable tightening system of the invention in the upwards direction.
Figure 6:
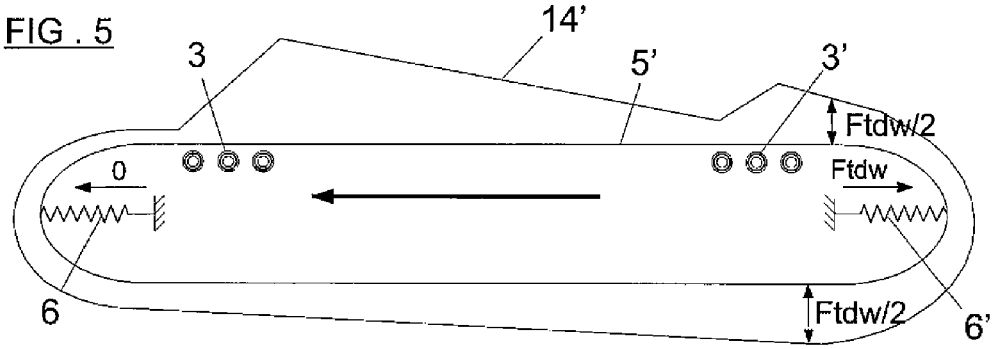
FIG. 6 shows the stress distributions in a walkway provided with the lockable tightening system of the invention operating in the downwards direction.

The bidirectional moving walkway shown in FIGS. 4-6, comprises:

two tightening units (6, 6') arranged at either end of the moving walkway and each comprising a locking system for locking the movable frame (7) of each end tightening unit (6, 6'), two drive units (3, 3') each arranged at either end of the moving walkway.

Figure 2:
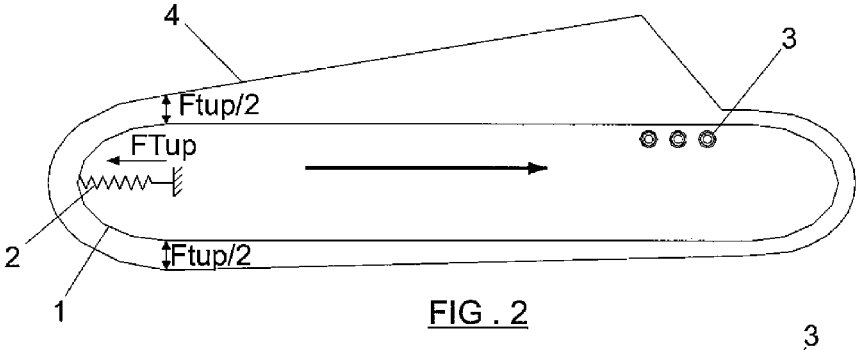
FIG. 2 shows the stress distributions in a conventional walkway operating in the upwards direction.
Figure 3:
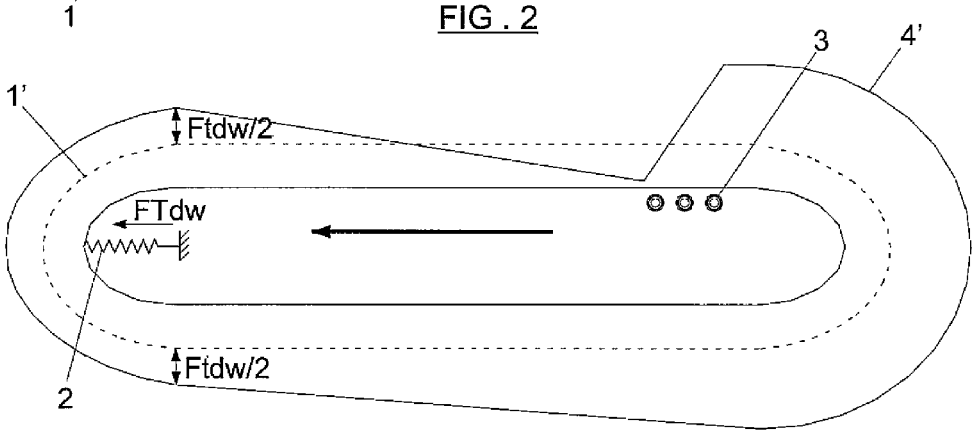
FIG. 3 shows the stress distributions in a conventional walkway operating in the downwards direction.

Tightening optimization is achieved since the locking system of each tightening unit (6, 6') of either end of the walkway is configured for locking the operation of the tightening unit when the drive unit (3, 3') of its same end is operated, such that the moving walkway always works with the tightening unit operated by the passenger entrance end and blocked by the passenger exit end, as seen in the "zero" tension lines (5, 5') with the stress distribution lines (14, 14') of the walkway of the invention (FIGS. 5 and 6) compared with the distribution lines (4, 4') of a conventional walkway and its "zero" level (1, 1') of FIGS. 2 and 3).

Figure 7:
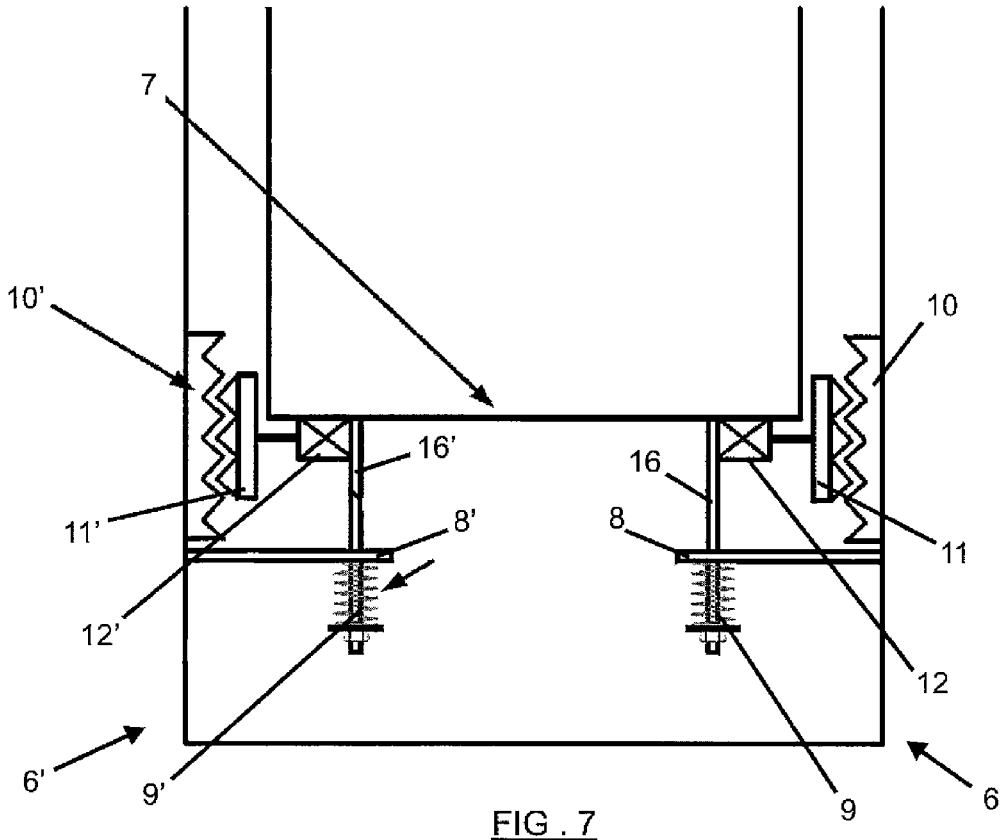
FIG. 7 shows a diagram of a system for locking the tightener by means of a rack.

As shown in FIGS. 4 and 7, the tightening unit (6, 6') of each end of the walkway comprises:

a movable frame (7) resting laterally on a fixed frame a fixed frame comprising two side walls (15, 15') and two cross walls (8, 8') fixed to the side walls (15, 15'), one tightening means (9, 9') for each cross wall (8, 8'), resting on the side walls (15, 15') of the fixed frame and comprising a shaft (16, 16') resting on the movable frame (7, 7'), a locking system comprising:

at least one actuator (12, 12') configured for being operated when the drive unit (3, 3') of the same end of the walkway comes into operation and movable locking means operated by the actuator (12, 12') configured for being coupled by tongue and groove to complementary fixed locking parts (10, 10') arranged in the side walls (15, 15') of the fixed frame.

The locking mechanism of the lockable tightening unit (6, 6') is based on preventing the relative movement of the movable frame (7) with respect to the fixed frame of the head of the walkway. Several systems can be used to carry out this locking, one of them is shown in FIG. 7 consisting of an actuator (12, 12'), preferably an electric actuator, firmly fixed to the movable frame (7), and a rod with rack-type cogging or its equivalent (11, 11'). When a tightening unit of one of the ends is to be locked, the actuators (12, 12') push the rod (11, 11') engaging its rack with a fixed part (10, 10') complementary fixed to the fixed frame such that both frames are completely attached. To unlock the tightening system, the actuator would only need to move its rack in the direction opposite the locking direction, disengaging it from the fixed part and allowing the relative movement between both frames.

Figure 8:
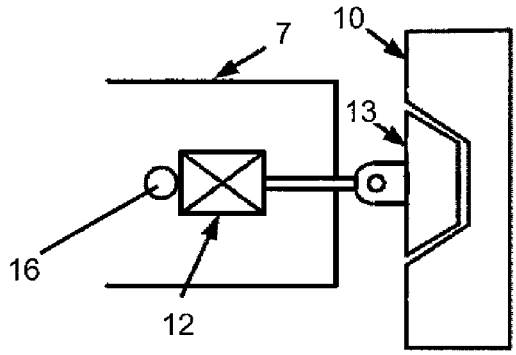
FIG. 8 shows a diagram of a system for locking the tightener by means of a shoe.

Another possible system would be that shown in FIG. 8, consisting of an actuator (12, 12') at either side of the end of the movable frame (7) and integral thereto, pushing a wedge-shaped shoe (13, 13') against the fixed frame provided with a complementary fixed part (10, 10') by way of a slit or notch with the suitable shape for assuring the maximum contact surface with the shoe (13, 13') by the coupling of the shoe in the notch. Similar to the above case, the tightening unit is locked when the actuator pushes the shoe (13, 13') against the fixed frame, immobilising both frames. Like the case above, to unlock the tightening unit, the actuators (12, 12') move the shoe in the opposite direction until there is no contact between the shoe and the fixed profile and the free movement of the movable frame with respect to the fixed frame is allowed.

The invention claimed is:

1. A bidirectional moving walkway with a tightening system for tightening a band of pallets of the walkway, comprising a movable frame resting laterally on a fixed frame having two side walls and two cross walls fixed to the side walls, and on which rests one tightener for each cross wall, comprising a shaft resting on the movable frame, comprising:

two end tightening units arranged at either end of the moving walkway, of the tightening units each comprising a locking system for locking the movable frame of each end tightening unit;

two drive units each arranged at either end of the moving walkway, the locking system of each tightening unit of either end of the walkway being configured for locking a operation of the tightening unit when the drive unit of a same end is operated, such that the moving walkway always works with the tightening unit operated by a passenger entrance end and locked by a passenger exit end.

2. The moving walkway according to claim 1, wherein the locking system for locking the movable frame of each tightening unit comprises:

at least one actuator configured for being operated when the drive unit of the same end of the walkway comes into operation; and movable locking means operated by the actuator configured for being coupled by tongue and groove to complementary fixed locking parts arranged in the side walls of the fixed frame.

3. The moving walkway according to claim 2, wherein the movable locking means comprise a part with a cogged profile and the fixed locking part comprises a cogged profile complementary to the movable part.

4. The moving walkway according to claim 2, wherein the movable locking comprise a shoe and the fixed locking part comprises a notch configured for coupling the shoe.

5. The moving walkway according to claim 1, wherein the tightening means of the movable frame comprise a spring.

* * * * *